US008118393B2

(12) United States Patent
Karppinen

(10) Patent No.: US 8,118,393 B2
(45) **Date of Patent: *Feb. 21, 2012**

(54) METHOD OF REMOVING FOREIGN PARTICULATES FROM PAGEWIDTH PRINTHEAD

(75) Inventor: Vesa Karppinen, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 422 days.

This patent is subject to a terminal disclaimer.

(21) Appl. No.: 12/368,971

(22) Filed: Feb. 10, 2009

(65) Prior Publication Data

US 2009/0147041 A1 Jun. 11, 2009

Related U.S. Application Data

(63) Continuation of application No. 11/246,708, filed on Oct. 11, 2005, now Pat. No. 7,506,952.

(51) Int. Cl.
*B41J 2/165* (2006.01)

(52) U.S. Cl. ..... 347/24; 347/28

(58) Field of Classification Search ..... 347/22–23, 347/28–33

See application file for complete search history.

(56) References Cited

U.S. PATENT DOCUMENTS

| | | | | |
|---|---|---|---|---|
| 5,574,485 | A | 11/1996 | Anderson et al. | |
| 6,158,839 | A * | 12/2000 | Fukushima et al. | 347/33 |
| 6,281,909 | B1 * | 8/2001 | Fassler et al. | 347/28 |
| 6,290,343 | B1 | 9/2001 | Lewis et al. | |
| 6,378,973 | B1 | 4/2002 | Kubota et al. | |
| 6,523,931 | B1 | 2/2003 | Cipolla et al. | |
| 7,370,936 | B2 * | 5/2008 | Karppinen et al. | 347/33 |
| 7,387,358 | B2 | 6/2008 | Karppinen et al. | |
| 7,401,886 | B2 * | 7/2008 | Karppinen et al. | 347/22 |
| 7,413,281 | B2 | 8/2008 | Karppinen et al. | |
| 7,604,334 | B2 | 10/2009 | Karppinen et al. | |
| 7,758,174 | B2 | 7/2010 | Karppinen et al. | |
| 2005/0019898 | A1 | 1/2005 | Adey et al. | |
| 2006/0209141 | A1 | 9/2006 | Kojima | |
| 2010/0188460 | A1 | 7/2010 | Brown et al. | |

FOREIGN PATENT DOCUMENTS

| | | | |
|---|---|---|---|
| DE | 3226773 | A1 | 2/1983 |
| DE | 3825046 | A1 | 1/1990 |
| JP | 11058901 | A | 3/1999 |
| JP | 2004-131202 | A | 4/2004 |
| WO | WO 88/08370 | A1 | 11/1988 |
| WO | WO 93/21020 | A1 | 10/1993 |

* cited by examiner

*Primary Examiner* — Jason Uhlenhake

(57) ABSTRACT

A method of removing foreign particulates from an ink ejection face of a pagewidth printhead mounted on a substrate. The substrate has a film guide positioned adjacent the printhead. The method comprises the steps of: (a) flooding the face with ink and dispersing the particulates into the flooded ink; (b) positioning a polymer film in a transfer zone so as to define a cavity defined by the ink ejection face, the film guide and the polymer film; and (c) guiding the polymer film through the transfer zone. The movement of the film in the transfer zone transfers the flooded ink onto the polymer film.

12 Claims, 5 Drawing Sheets

METHOD OF REMOVING FOREIGN PARTICULATES FROM PAGEWIDTH PRINTHEAD

CROSS REFERENCE TO RELATED APPLICATIONS

This application is a continuation of U.S. application Ser. No. 11/246,708 filed on Oct. 11, 2005, now issued U.S. Pat. No. 7,506.952, all of which are herein incorporated by reference.

CO-PENDING APPLICATIONS

The following applications have been filed by the Applicant simultaneously with application Ser. No. 11/246,708:

| | | | | |
|---|---|---|---|---|
| 11/246,676 | 7,472,981 | 7,448,722 | 11/246,679 | 7,438,381 |
| 7,441,863 | 7,438,382 | 7,425,051 | 7,399,057 | 11/246,671 |
| 11/246,670 | 11/246,669 | 7,448,720 | 7,448,723 | 7,445,310 |
| 7,399,054 | 7,425,049 | 7,367,648 | 7,370,936 | 7,401,886 |
| 7,401,887 | 7,384,119 | 7,401,888 | 7,387,358 | 7,413,281 |
| 11/246,687 | 11/246,718 | 7,322,681 | 11/246,686 | 11/246,703 |
| 11/246,691 | 11/246,711 | 7,465,041 | 11/246,712 | 7,465,032 |
| 7,401,890 | 7,401,910 | 7,470,010 | 11/246,702 | 7,431,432 |
| 7,465,037 | 7,445,317 | 11/246,699 | 11/246,675 | 11/246,674 |
| 11/246,667 | 7,303,930 | 11/246,672 | 7,401,405 | 7,464,466 |
| 7,464,465 | | | | |

The disclosures of these co-pending applications are incorporated herein by reference.

CROSS REFERENCES TO RELATED APPLICATIONS

Various methods, systems and apparatus relating to the present invention are disclosed in the following US patents/patent applications filed by the applicant or assignee of the present invention:

| | | | | |
|---|---|---|---|---|
| 6,750,901 | 6,476,863 | 6,788,336 | 7,249,108 | 6,566,858 |
| 6,331,946 | 6,246,970 | 6,442,525 | 7,346,586 | 09/505,951 |
| 6,374,354 | 7,246,098 | 6,816,968 | 6,757,832 | 6,334,190 |
| 6,745,331 | 7,249,109 | 7,197,642 | 7,093,139 | 10/636,263 |
| 10/636,283 | 10/866,608 | 7,210,038 | 7,401,223 | 10/940,653 |
| 10/942,858 | 7,364,256 | 7,258,417 | 7,293,853 | 7,328,968 |
| 7,270,395 | 7,461,916 | 11/003,419 | 7,334,864 | 7,255,419 |
| 7,284,819 | 7,229,148 | 7,258,416 | 7,273,263 | 7,270,393 |
| 6,984,017 | 7,347,526 | 7,357,477 | 7,465,015 | 7,364,255 |
| 7,357,476 | 11/003,614 | 7,284,820 | 7,341,328 | 7,246,875 |
| 7,322,669 | 6,623,101 | 6,406,129 | 6,505,916 | 6,457,809 |
| 6,550,895 | 6,457,812 | 7,152,962 | 6,428,133 | 7,204,941 |
| 7,282,164 | 7,465,342 | 7,278,727 | 7,417,141 | 7,452,989 |
| 7,367,665 | 7,138,391 | 7,153,956 | 7,423,145 | 7,456,277 |
| 10/913,376 | 7,122,076 | 7,148,345 | 11/172,816 | 7,470,315 |
| 11/172,814 | 7,416,280 | 7,252,366 | 10/683,064 | 7,360,865 |
| 6,746,105 | 7,156,508 | 7,159,972 | 7,083,271 | 7,165,834 |
| 7,080,894 | 7,201,469 | 7,090,336 | 7,156,489 | 7,413,283 |
| 7,438,385 | 7,083,257 | 7,258,422 | 7,255,423 | 7,219,980 |
| 10/760,253 | 7,416,274 | 7,367,649 | 7,118,192 | 10/760,194 |
| 7,322,672 | 7,077,505 | 7,198,354 | 7,077,504 | 10/760,189 |
| 7,198,355 | 7,401,894 | 7,322,676 | 7,152,959 | 7,213,906 |
| 7,178,901 | 7,222,938 | 7,108,353 | 7,104,629 | 7,246,886 |
| 7,128,400 | 7,108,355 | 6,991,322 | 7,287,836 | 7,118,197 |
| 10/728,784 | 7,364,269 | 7,077,493 | 6,962,402 | 10/728,803 |
| 7,147,308 | 10/728,779 | 7,118,198 | 7,168,790 | 7,172,270 |
| 7,229,155 | 6,830,318 | 7,195,342 | 7,175,261 | 7,465,035 |
| 7,108,356 | 7,118,202 | 10/773,186 | 7,134,744 | 10/773,185 |
| 7,134,743 | 7,182,439 | 7,210,768 | 7,465,036 | 7,134,745 |
| 7,156,484 | 7,118,201 | 7,111,926 | 7,431,433 | 7,018,021 |

-continued

| | | | | |
|---|---|---|---|---|
| 7,401,901 | 7,468,139 | 11/188,017 | 11/097,308 | 7,448,729 |
| 7,246,876 | 7,431,431 | 7,419,249 | 7,377,623 | 7,328,978 |
| 7,334,876 | 7,147,306 | 09/575,197 | 7,079,712 | 6,825,945 |
| 7,330,974 | 6,813,039 | 6,987,506 | 7,038,797 | 6,980,318 |
| 6,816,274 | 7,102,772 | 7,350,236 | 6,681,045 | 6,728,000 |
| 7,173,722 | 7,088,459 | 09/575,181 | 7,068,382 | 7,062,651 |
| 6,789,194 | 6,789,191 | 6,644,642 | 6,502,614 | 6,622,999 |
| 6,669,385 | 6,549,935 | 6,987,573 | 6,727,996 | 6,591,884 |
| 6,439,706 | 6,760,119 | 7,295,332 | 6,290,349 | 6,428,155 |
| 6,785,016 | 6,870,966 | 6,822,639 | 6,737,591 | 7,055,739 |
| 7,233,320 | 6,830,196 | 6,832,717 | 6,957,768 | 7,456,820 |
| 7,170,499 | 7,106,888 | 7,123,239 | 10/727,181 | 10/727,162 |
| 7,377,608 | 7,399,043 | 7,121,639 | 7,165,824 | 7,152,942 |
| 10/727,157 | 7,181,572 | 7,096,137 | 7,302,592 | 7,278,034 |
| 7,188,282 | 10/727,159 | 10/727,180 | 10/727,179 | 10/727,192 |
| 10/727,274 | 10/727,164 | 10/727,161 | 10/727,198 | 10/727,158 |
| 10/754,536 | 10/754,938 | 10/727,160 | 10/934,720 | 7,171,323 |
| 7,369,270 | 6,795,215 | 7,070,098 | 7,154,638 | 6,805,419 |
| 6,859,289 | 6,977,751 | 6,398,332 | 6,394,573 | 6,622,923 |
| 6,747,760 | 6,921,144 | 10/884,881 | 7,092,112 | 7,192,106 |
| 7,457,001 | 7,173,739 | 6,986,560 | 7,008,033 | 11/148,237 |
| 7,195,328 | 7,182,422 | 7,374,266 | 7,427,117 | 7,448,707 |
| 7,281,330 | 10/854,503 | 7,328,956 | 10/854,509 | 7,188,928 |
| 7,093,989 | 7,377,609 | 10/854,495 | 10/854,498 | 10/854,511 |
| 7,390,071 | 10/854,525 | 10/854,526 | 10/854,516 | 7,252,353 |
| 10/854,515 | 7,267,417 | 10/854,505 | 10/854,493 | 7,275,805 |
| 7,314,261 | 10/854,490 | 7,281,777 | 7,290,852 | 10/854,528 |
| 10/854,523 | 10/854,527 | 10/854,524 | 10/854,520 | 10/854,514 |
| 10/854,519 | 10/854,513 | 10/854,499 | 10/854,501 | 7,266,661 |
| 7,243,193 | 10/854,518 | 10/934,628 | 7,163,345 | 7,448,734 |
| 7,425,050 | 7,364,263 | 7,201,468 | 7,360,868 | 10/760,249 |
| 7,234,802 | 7,303,255 | 7,287,846 | 7,156,511 | 10/760,264 |
| 7,258,432 | 7,097,291 | 10/760,222 | 10/760,248 | 7,083,273 |
| 7,367,647 | 7,374,355 | 7,441,880 | 10/760,205 | 10/760,206 |
| 10/760,267 | 10/760,270 | 7,198,352 | 7,364,264 | 7,303,251 |
| 7,201,470 | 7,121,655 | 7,293,861 | 7,232,208 | 7,328,985 |
| 7,344,232 | 7,083,272 | 11/014,764 | 11/014,763 | 7,331,663 |
| 7,360,861 | 7,328,973 | 7,427,121 | 7,407,262 | 7,303,252 |
| 7,249,822 | 11/014,762 | 7,311,382 | 7,360,860 | 7,364,257 |
| 7,390,075 | 7,350,896 | 7,429,096 | 7,384,135 | 7,331,660 |
| 7,416,287 | 11/014,737 | 7,322,684 | 7,322,685 | 7,311,381 |
| 7,270,405 | 7,303,268 | 7,470,007 | 7,399,072 | 7,393,076 |
| 11/014,750 | 11/014,749 | 7,249,833 | 11/014,769 | 11/014,729 |
| 7,331,661 | 11/014,733 | 7,300,140 | 7,357,492 | 7,357,493 |
| 11/014,766 | 7,380,902 | 7,284,816 | 7,284,845 | 7,255,430 |
| 7,390,080 | 7,328,984 | 7,350,913 | 7,322,671 | 7,380,910 |
| 7,431,424 | 7,470,006 | 11/014,732 | 7,347,534 | 7,441,865 |
| 7,469,989 | 7,367,650 | | | |

The disclosures of these applications and patents are incorporated herein by reference.

FIELD OF THE INVENTION

This invention relates to a printhead maintenance assembly for an inkjet printhead. It has been developed primarily for facilitating maintenance operations, such as cleaning particulates from an ink ejection face of the printhead.

BACKGROUND OF THE INVENTION

Inkjet printers are commonplace in homes and offices. However, all commercially available inkjet printers suffer from slow print speeds, because the printhead must scan across a stationary sheet of paper. After each sweep of the printhead, the paper advances incrementally until a complete printed page is produced.

It is a goal of inkjet printing to provide a stationary pagewidth printhead, whereby a sheet of paper is fed continuously past the printhead, thereby increasing print speeds greatly. The present Applicant has developed many different types of pagewidth inkjet printheads using MEMS technology, some of which are described in the patents and patent applications listed in the above cross reference list.

The contents of these patents and patent applications are incorporated herein by cross-reference in their entirety.

Notwithstanding the technical challenges of producing a pagewidth inkjet printhead, a crucial aspect of any inkjet printing is maintaining the printhead in an operational printing condition throughout its lifetime. A number of factors may cause an inkjet printhead to become non-operational and it is important for any inkjet printer to include a strategy for preventing printhead failure and/or restoring the printhead to an operational printing condition in the event of failure. Printhead failure may be caused by, for example, printhead face flooding, dried-up nozzles (due to evaporation of water from the nozzles—a phenomenon known in the art as decap), or particulates fouling nozzles.

Particulates, in the form of paper dust, are a particular problem in high-speed pagewidth printing. This is because the paper is typically fed at high speed over a paper guide and past the printhead. Frictional contact of the paper with the paper guide generates large quantities of paper dust compared to traditional scanning inkjet printheads, where paper is fed much more slowly. Hence, pagewidth printheads tend to accumulate paper dust on their ink ejection face during printing. This accumulation of paper dust is highly undesirable.

In the worst case scenario, paper dust blocks nozzles on the printhead, preventing those nozzles from ejecting ink. More usually, paper dust overlies nozzles and partially covers nozzle apertures. Nozzle apertures that are partially covered or blocked produce misdirected ink droplets during printing—the ink droplets are deflected from their intended trajectory by particulates on the ink ejection face. Misdirects are highly undesirable and may result in acceptably low print quality.

One measure that has been used for maintaining printheads in an operational condition is sealing the printhead, which prevents the ingress of particulates and also prevents evaporation of ink from nozzles. Commercial inkjet printers are typically supplied with a sealing tape across the printhead, which the user removes when the printer is installed for use. The sealing tape protects the primed printhead from particulates and prevents the nozzles from drying up during transit. Sealing tape also controls flooding of ink over the printhead face.

Aside from one-time use sealing tape on new printers, sealing has also been used as a strategy for maintaining printheads in an operational condition during printing. In some commercial printers, a gasket-type sealing ring and cap engages around a perimeter of the printhead when the printer is idle. A vacuum may be connected to the sealing cap and used to suck ink from the nozzles, unblocking any nozzles that have dried up. However, whilst sealing/vacuum caps may prevent the ingress of particulates from the atmosphere, such measures do not remove particulates already built up on the printhead.

In order to remove flooded ink from a printhead after vacuum flushing, prior art maintenance stations typically employ a rubber squeegee, which is wiped across the printhead. Particulates are removed from the printhead by flotation into the flooded ink and the squeegee removes the flooded ink having particulates dispersed therein.

However, rubber squeegees have several shortcomings when used with MEMS pagewidth printheads. A typical MEMS printhead has a nozzle plate comprised of a hard, durable material such as silicon nitride, silicon oxide, aluminum nitride etc. Moreover, the nozzle plate is typically relatively abrasive due to etched features on its surface. On the one hand, it is important to protect the nozzle plate, comprising sensitive nozzle structures, from damaging exposure to the shear forces exerted by a rubber squeegee. On the other hand, it is equally important that a rubber squeegee should not be damaged by contact with the printhead and reduce its cleaning efficacy.

Therefore, it would be desirable to provide an inkjet printhead maintenance station, which does not rely on a rubber squeegee wiping across the nozzle plate to remove flood ink and particulates. It would further be desirable to provide an inkjet printhead maintenance station, which removes flooded ink and particulates from the nozzle plate without the nozzle plate coming into contact with any cleaning surface.

It would further be desirable to provide an ink jet printhead maintenance station that is simple in design, does not consume large amounts power and can be readily incorporated into a desktop printer.

SUMMARY OF THE INVENTION

In a first aspect, there is provided a printhead maintenance assembly for maintaining a printhead in an operable condition, said maintenance assembly comprising:

(i) a printhead assembly comprising:

a printhead having an ink ejection face, said face having a first edge portion and a second edge portion opposite said first edge portion; and a film guide sealingly bonded to said first edge portion, said film guide being positioned to guide a film through a transfer zone, said transfer zone being defined by a plane spaced apart from said face; and (ii) an ink transport assembly comprising:

a film for transporting ink away from said printhead; and a transport mechanism for feeding said film through said transfer zone and away from said printhead, said transport mechanism feeding said film in a directional sense which is from said first edge portion to said second edge portion;

wherein, in use, said film contacts with said film guide thereby forming a cavity defined at least partially by said film, said film guide and said face.

In a second aspect, there is provided a method of maintaining a printhead in an operable condition, said method comprising the steps of:

(i) providing a printhead assembly, said printhead assembly comprising:

a printhead having an ink ejection face, said face having a first edge portion and a second edge portion opposite said first edge portion; and a film guide sealingly bonded to said first edge portion, said film guide being positioned to guide a film through a transfer zone, said transfer zone being defined by a plane spaced apart from said face;

(ii) positioning at least part of a film in said transfer zone and in contact with said film guide, thereby forming a cavity defined at least partially by said film, said film guide and said face; and (iii) feeding said film through said transfer zone and away from said printhead, thereby removing ink from said cavity, said film being fed in a directional sense which is from said first edge portion to said second edge portion.

In a third aspect, there is provided a method of removing flooded ink from an ink ejection face of a printhead, said method comprising transferring said ink onto a film moving past said face, wherein said film does not contact said face.

In a fourth aspect, there is provided a method of removing particulates from an ink ejection face of a printhead, said method comprising the steps of:

(a) flooding said face with ink from said printhead, thereby dispersing said particulates into said flooded ink; and (b) transferring said flooded ink, including said particulates, onto a film moving past said face, wherein said film does not contact said face.

The maintenance assembly and method of the present application advantageously allow particulates to be removed from a printhead, whilst avoiding contact of the printhead with an external cleaning device. Hence, unlike prior art squeegee-cleaning methods, the unique cleaning action of the present invention does not impart any shear forces across the printhead and does not damage sensitive nozzle structures. Moreover, the film in the present invention, which does not come into contact with the printhead, is not damaged by the printhead and can therefore be used repeatedly whilst maintaining optimal cleaning action.

A further advantage of the maintenance assembly is that it has a simple design, which can be manufactured at low cost and consumes very little power. The suction devices of the prior art require external pumps, which add significantly to the cost and power consumption of prior art printers. By obviating the need for a vacuum pump, the power requirements of the printer are significantly reduced.

A further advantage of the maintenance assembly and method is that it consumes very little ink compared to prior art suction devices.

The principle of the cleaning action used by the present invention will be described in more detail below. Various optional features of the invention will first be summarized as follows.

Optionally, the film guide is positioned along a first longitudinal edge portion of the printhead. Typically, inkjet printheads (comprised of one or more abutting printhead integrated circuits) have encapsulated wire bonds extending from a longitudinal edge portion. The encapsulant material may be used in the present invention as the film guide. Usually, the encapsulant is a solid polymeric material, which protects the wire bonds from ink and prevents shorting.

Optionally, the transfer zone is substantially parallel with the ink ejection face of the printhead. The distance between the transfer zone and the ink ejection face is typically defined by the film guide, or the depth of encapsulant projecting from the ink ejection face. Optionally, the transfer zone is less than 2 mm from the ink ejection face, or optionally less than 2 mm, or optionally less than 0.5 mm.

The film itself may be comprised of any suitably robust material, such as plastics. Examples of suitable plastics are polyethylene, polypropylene, polycarbonates, polyesters and polyacrylates. Optionally, the film is wetting or hydrophilic to maximize transport of ink away from the printhead. The film may be comprised of a hydrophilic polymer or, alternatively, the film may be coated with a hydrophilic coating (e.g. silica particle coating) to impart wetting properties onto the film. Films suitable for use in the present invention are commercially available from, for example, Dupont Teijin Films.

Optionally, the film is fed through the transfer zone by winding the film from a supply spool onto a take-up spool. Alternatively, the film is an endless loop, which can be fed in a circuit continuously through the transfer zone.

Optionally, a width of the film is substantially coextensive with a length of the printhead. This ensures that the whole printhead is cleaned by the film.

Optionally, the ink transport assembly further comprises a film cleaner. The transport mechanism is typically configured to feed the film past the film cleaner after it has passed through the transfer zone. The film cleaner is usually positioned remotely from the printhead in order to avoid any recontamination of the printhead. The film cleaner may take the form of an absorbent pad or a rubber squeegee, which wipes ink from the film.

Optionally, the cavity defined by the film guide, the ink ejection face and the film, is open-ended at the second edge portion of the ink ejection face. With the cavity open to the atmosphere at one end, pressure in the cavity is equalized as ink is withdrawn from the cavity by the film. Hence, ink may be continuously removed from the cavity.

During printing, the transfer zone should be free of the film so that ink can be ejected onto print media fed past the printhead. Optionally, the ink transport assembly is moveable between a first position in which the film is positioned in the transfer zone and a second position in which the film is positioned remotely from the transfer zone. The first position is a printhead-cleaning configuration, whilst the second position is a printing configuration.

Optionally, the maintenance assembly further comprises a face flooding system for flooding ink from the printhead onto the ink ejection face. Ink is typically flooded onto the face from the printhead before positioning the film over the film guide and feeding the film through the transfer zone. Alternatively, the face may be flooded after positioning the film over the film guide, thereby flooding the cavity. Flooding the face floats particles trapped on the ink ejection face, which then become dispersed in the flooded ink. The flooded ink, together with its dispersion of particles, may be then transported away from the printhead by the moving film.

As used herein, the term "ink" refers to any liquid fed from an ink reservoir to the printhead and ejected from nozzles in the printhead. Optionally, the ink is a cleaning liquid (e.g. water, dyeless ink base, gycol solution etc.) which is not used for printing, but instead used specifically for cleaning the ink ejection face of the printhead.

Optionally, the face flooding system comprises a pressure system for positively pressurizing an ink reservoir supplying ink to the printhead. By applying a positive pressure to the ink reservoir, ink is forced from the nozzles onto the ink ejection face. Forcing ink from the nozzles in this way not only floods the face and disperses particulates, but also unblocks any nozzles which have decapped during printing. Hence, the present invention may perform the dual functions of unblocking nozzles and cleaning particulates from the ink ejection face.

Typically, the ink reservoir comprises one or more ink bags, which can be pressurized by, for example, mechanically squeezing or using a pressurized ink bag container. Optionally, the pressure system comprises a control system for controlling an amount and/or a period of pressure applied to the ink reservoir. For example, the control system may be used to deliver a short burst of positive pressure in order to flood the face for cleaning. However, in a printing mode, it is generally desirable to maintain a slight negative pressure in the air bags in order to counterpoise the capillary draw from the nozzles and prevent ink from flooding across the ink ejection face uncontrollably. The control system may be used to actively control pressure in the air bags for cleaning and/or printing.

Optionally, the printhead assembly further comprises a print media guide for guiding print media past the printhead. Typically, the print media is fed past the printhead in a directional sense, which is opposite to the feed direction of the film. Accordingly, the print media guide is usually positioned on an opposite side of the printhead to the film guide.

Optionally, the print media guide is moveable between a media-guiding position and a retracted position. In its retracted position, the print media guide allows the film to be fed through the transfer zone and, moreover, avoids sealing the cavity by the film contacting with the print media guide. Alternatively, undesirable sealing of the cavity may be avoided by having vents in the print media guide. Vents may take the form of recesses or openings in the print media guide, which allow pressure in the cavity to be equalized during removal of ink by the film.

The invention has been developed primarily for use with a MEMS pagewidth inkjet printhead. However, the invention is equally applicable to any type of printhead where remedial measures are required to maintain the printhead in an operable condition. For example, the invention may be used in connection with standard scanning inkjet printheads in order to avoid printhead damage during maintenance.

In a first aspect the present invention provides a printhead maintenance assembly for maintaining a printhead in an operable condition, said maintenance assembly comprising:

(i) a printhead assembly comprising:
- a printhead having an ink ejection face, said face having a first edge portion and a second edge portion opposite said first edge portion; and
- a film guide sealingly bonded to said first edge portion, said film guide being positioned to guide a film through a transfer zone, said transfer zone being defined by a plane spaced apart from said face; and (ii) an ink transport assembly comprising:
- a film for transporting ink away from said printhead; and
- a transport mechanism for feeding said film through said transfer zone and away from said printhead, said transport mechanism feeding said film in a directional sense which is from said first edge portion to said second edge portion;
- wherein, in use, said film contacts with said film guide thereby forming a cavity defined at least partially by said film, said film guide and said face.

Optionally, said printhead is a pagewidth inkjet printhead.

Optionally, said first and second edge portions are longitudinal edge portions.

Optionally, said film guide is comprised of a solid polymeric material.

Optionally, said film guide encapsulates wire bonds extending from said first edge portion of said printhead.

Optionally, said transfer zone is substantially parallel with said ink ejection face.

Optionally, said transfer zone is less than 1 mm from said face.

Optionally, said film is wetting.

Optionally, said film is an endless loop.

Optionally, a width of said film is substantially coextensive with a length of said printhead.

Optionally, said ink transport assembly further comprises a film cleaner, said transport mechanism being configured to feed said film past said film cleaner.

Optionally, said film cleaner is an absorbent pad positioned remotely from said printhead.

Optionally, said cavity is open-ended at said second edge portion.

Optionally, said ink transport assembly is moveable between a first position in which said film is positioned in said transfer zone and a second position in which said film is positioned remotely from said transfer zone.

In a further aspect there is provided a maintenance assembly, further comprising:

(iii) a face flooding system for flooding ink from said printhead onto said ink ejection face.

Optionally, said face flooding system comprises a pressure system for positively pressurizing an ink reservoir supplying ink to said printhead.

Optionally, said pressure system comprises a control system for controlling an amount and/or a period of pressure applied to said ink reservoir.

Optionally, said printhead assembly further comprises a print media guide for guiding print media past said printhead.

Optionally, said print media guide is moveable between a media-guiding position and a retracted position.

Optionally, said print media guide is positioned on an opposite side of said printhead to said film guide.

In a second aspect the present invention provides a method of maintaining a printhead in an operable condition, said method comprising the steps of:

(i) providing a printhead assembly, said printhead assembly comprising:
- a printhead having an ink ejection face, said face having a first edge portion and a second edge portion opposite said first edge portion; and
- a film guide sealingly bonded to said first edge portion, said film guide being positioned to guide a film through a transfer zone, said transfer zone being defined by a plane spaced apart from said face;

(ii) positioning at least part of a film in said transfer zone and in contact with said film guide, thereby forming a cavity defined at least partially by said film, said film guide and said face; and (iii) feeding said film through said transfer zone and away from said printhead, thereby removing ink from said cavity, said film being fed in a directional sense which is from said first edge portion to said second edge portion.

Optionally, said printhead is a pagewidth inkjet printhead.

Optionally, said first and second edge portions are longitudinal edge portions.

Optionally, said film guide is comprised of a solid polymeric material.

Optionally, said film guide encapsulates wire bonds extending from said first edge portion of said printhead.

Optionally, said transfer zone is substantially parallel with said ink ejection face.

Optionally, said transfer zone is less than 2 mm from said face.

Optionally, said film is wetting.

Optionally, said film is an endless loop.

Optionally, a width of said film is substantially coextensive with a length of said printhead.

Optionally, said film is fed past a film cleaner after being fed through said transfer zone.

Optionally, said film cleaner is an absorbent pad positioned remotely from said printhead.

Optionally, said cavity is open-ended at said second edge portion.

Optionally, said film is moveable between a first position in which said film is positioned in said transfer zone and a second position in which said film is positioned remotely from said transfer zone Optionally, said face is flooded with ink from said printhead prior to feeding said film through said transfer zone.

Optionally, said face is flooded by positively pressurizing an ink reservoir supplying ink to said printhead.

Optionally, an amount and/or a period of pressure applied to said ink reservoir is controlled.

Optionally, said printhead assembly further comprises a print media guide for guiding print media past said printhead.

Optionally, said print media is guide is moved out of a media-guiding position prior to positioning said film in said transfer zone.

Optionally, said print media is guide is moved into a media-guiding position after feeding said film through said transfer zone.

In a third aspect the present invention provides a method of removing flooded ink from an ink ejection face of a printhead, said method comprising transferring said ink onto a film moving past said face, wherein said film does not contact said face.

Optionally, said film is guided past said face using a film guide.

Optionally, at least part of said face, said film and said film guide form a cavity for containing said ink.

Optionally, said cavity is open-ended.

Optionally, said printhead is a pagewidth inkjet printhead.

Optionally, said film guide is comprised of a solid polymeric material.

Optionally, said film guide encapsulates wire bonds extending from said printhead.

Optionally, said film is moved past said face substantially parallel therewith.

Optionally, said film is less than 2 mm from said face.

Optionally, said film is wetting.

Optionally, a width of said film is substantially coextensive with a length of said printhead.

Optionally, said film is fed past a film cleaner after being fed past said face.

Optionally, said film cleaner is an absorbent pad positioned remotely from said printhead.

Optionally, ink is flooded across said face prior to moving said film past said face Optionally, said face is flooded by positively pressurizing an ink reservoir supplying ink to said printhead.

Optionally, an amount and/or a period of pressure applied to said ink reservoir is controlled.

In a fourth aspect the present invention provides a method of removing particulates from an ink ejection face of a printhead, said method comprising the steps of:

(a) flooding said face with ink from said printhead, thereby dispersing said particulates into said flooded ink; and (b) transferring said flooded ink, including said particulates, onto a film moving past said face, wherein said film does not contact said face.

Optionally, said film is guided past said face using a film guide.

Optionally, at least part of said face, said film and said film guide form a cavity for containing said ink.

Optionally, said cavity is open-ended.

Optionally, said printhead is a pagewidth inkjet printhead.

Optionally, said film guide is comprised of a solid polymeric material.

Optionally, said film guide encapsulates wire bonds extending from said printhead.

Optionally, said film is moved past said face substantially parallel therewith.

Optionally, said film is less than 2 mm from said face.

Optionally, said film is wetting.

Optionally, a width of said film is substantially coextensive with a length of said printhead.

Optionally, said film is fed past a film cleaner after being fed past said face.

Optionally, said film cleaner is an absorbent pad positioned remotely from said printhead.

Optionally, said face is flooded with ink by positively pressurizing an ink reservoir supplying ink to said printhead.

Optionally, an amount and/or a period of pressure applied to said ink reservoir is controlled.

In a fifth aspect the present invention provides a method of maintaining a printhead in an operable condition, said method comprising the steps of:

(a) flooding an ink ejection face of said printhead with ink; and (b) removing said ink by blasting air across said face.

Optionally, said face is flooded by suction.

Optionally, said suction purges nozzles in said printhead.

Optionally, a capper is sealingly engaged around said printhead during printhead maintenance.

Optionally, said capper is disengaged from around said printhead during printing.

Optionally, said capper comprises a perimeter gasket for sealing engagement around said printhead.

Optionally, said capper is in fluid communication with a vacuum system, said vacuum system flooding said face by generating a vacuum above said face.

Optionally, said vacuum system comprises a vacuum pump.

Optionally, air is blasted through a blast channel adjacent said face.

Optionally, said blast channel is defined by a constriction member spaced apart from said face, said constriction member constricting air flow across said face.

Optionally, said constriction member is substantially coextensive with said printhead.

Optionally, said capper comprises a constriction member, said constriction member defining a blast channel adjacent said printhead when said capper is engaged around said printhead.

Optionally, air is blasted through said blast channel by releasing said vacuum to atmosphere.

Optionally, said capper is in fluid communication with an air inlet valve, said vacuum system, said constriction member and said air inlet valve cooperating to blast air through said blast channel.

Optionally, said vacuum system and said air inlet valve are arranged to control a direction of air flow through said blast channel.

Optionally, said vacuum system further comprises a vacuum reservoir, said reservoir being charged before flooding of said face.

Optionally, said reservoir is discharged during air blasting.

Optionally, said vacuum system further comprises an ink dump for receiving ink removed from said face during said air blast.

Optionally, said vacuum system directs said removed ink into said ink dump during air blasting.

Optionally, said printhead is a pagewidth inkjet printhead.

In a sixth aspect the present invention provides a printhead maintenance station for maintaining a printhead in an operable condition, said maintenance station comprising:

a capper sealingly engageable around said printhead, said capper comprising a constriction member for defining a blast channel adjacent an ink ejection face of said printhead;

an air inlet valve in fluid communication with said capper;

a vacuum system in fluid communication with said capper; and an engagement mechanism for moving said capper between a first position in which said capper is sealingly engaged around said printhead and a second position in which said capper is disengaged from around said printhead.

Optionally, said capper comprises a perimeter gasket for sealing engagement around said printhead.

Optionally, said vacuum system comprises a vacuum pump.

Optionally, said vacuum system is configured for generating a vacuum above said face, said vacuum purging ink from printhead nozzles onto said face.

Optionally, in said first position, said constriction member is spaced apart from said face, thereby defining said blast channel.

Optionally, said constriction member is spaced less than 0.5 mm from said face.

Optionally, said constriction member is substantially coextensive with said printhead.

Optionally, said capper comprises an air inlet port and a vacuum port.

Optionally, said vacuum system, said air inlet valve and said constriction member cooperate for blasting air through said blast channel, thereby removing ink from said face.

Optionally, said vacuum system and said air inlet valve are arranged to control a direction of air flow through said blast channel.

Optionally, said printhead comprises a wire bond encapsulant along one edge, and said air flow buffets into said encapsulant.

Optionally, said air flows transversely across said face.

Optionally, said vacuum system further comprises a vacuum reservoir.

Optionally, said vacuum system is configured for charging said vacuum reservoir before purging of said printhead nozzles.

Optionally, said vacuum system is configured for discharging said vacuum reservoir during air blasting.

Optionally, said vacuum system further comprises an ink dump for receiving ink removed from said face during said air blasting.

Optionally, said vacuum system is configured for directing said removed ink into said ink dump during air blasting.

Optionally, said printhead is a pagewidth inkjet printhead.

In a seventh aspect the present invention provides a method of maintaining a printhead in an operable condition, said method comprising the steps of:

(i) providing a printhead maintenance station, said maintenance station comprising:
  - a capper sealingly engageable around said printhead, said capper comprising a constriction member for defining a blast channel adjacent an ink ejection face of said printhead;
  - a vacuum system in fluid communication with said capper;
  - an air inlet valve in fluid communication with said capper; and
  - an engagement mechanism for moving said capper between a first position in which said capper is sealingly engaged around said printhead and a second position in which said capper is disengaged from around said printhead;

(ii) moving said capper into said first position such that said constriction member is spaced apart from said face, thereby defining said blast channel;

(iii) generating a vacuum over said face using said vacuum system, thereby purging ink from printhead nozzles onto said face; and (iv) opening said air inlet valve, thereby blasting air through said blast channel and removing ink from said face.

Optionally, the method comprising the further step of:

(v) moving said capper into said second position.

Optionally, the method comprising the further step of:

(vi) dabbing ink from around said printhead.

Optionally, said capper comprises a perimeter gasket for sealing engagement around said printhead.

Optionally, said vacuum system comprises a vacuum pump.

Optionally, said constriction member is spaced less than 0.5 mm from said face in said first position.

Optionally, said constriction member is substantially coextensive with said printhead.

Optionally, said vacuum system and said air inlet valve are arranged to control a direction of air flow through said blast channel.

Optionally, said printhead comprises a wire bond encapsulant along one edge, and said air flow buffets into said encapsulant.

Optionally, said air flows transversely across said face.

Optionally, said vacuum system further comprises a vacuum reservoir.

Optionally, said vacuum reservoir is charged prior to said purging.

Optionally, said vacuum reservoir is discharged during said air blasting.

Optionally, said vacuum system further comprises an ink dump for receiving ink removed from said face during said air blasting.

Optionally, said vacuum system directs said removed ink into said ink dump during air blasting.

Optionally, said printhead is a pagewidth inkjet printhead.

In an eighth aspect the present invention provides a printhead maintenance assembly comprising:

a printhead; and a printhead maintenance station for maintaining said printhead in an operable condition, said maintenance station comprising:
  - a capper sealingly engageable around said printhead, said capper comprising a constriction member for defining a blast channel adjacent an ink ejection face of said printhead;
  - an air inlet valve in fluid communication with said capper;
  - a vacuum system in fluid communication with said capper; and
  - an engagement mechanism for moving said capper between a first position in which said capper is sealingly engaged around said printhead and a second position in which said capper is disengaged from around said printhead.

Optionally, said capper comprises a perimeter gasket for sealing engagement around said printhead.

Optionally, said vacuum system comprises a vacuum pump.

Optionally, said vacuum system is configured for generating a vacuum above said face, said vacuum purging ink from printhead nozzles onto said face.

Optionally, in said first position, said constriction member is spaced apart from said face, thereby defining said blast channel.

Optionally, said constriction member is spaced less than 0.5 mm from said face.

Optionally, said constriction member is substantially coextensive with said printhead.

Optionally, said capper comprises an air inlet port and a vacuum port.

Optionally, said vacuum system, said air inlet valve and said constriction member cooperate for blasting air through said blast channel, thereby removing ink from said face.

Optionally, said vacuum system and said air inlet valve are arranged to control a direction of air flow through said blast channel.

Optionally, said printhead comprises a wire bond encapsulant along one edge, and said air flow buffets into said encapsulant.

Optionally, said vacuum system further comprises a vacuum reservoir.

Optionally, said vacuum system is configured for charging said vacuum reservoir before purging of said printhead nozzles.

Optionally, said vacuum system is configured for discharging said vacuum reservoir during air blasting.

Optionally, said vacuum system further comprises an ink dump for receiving ink removed from said face during said air blasting.

Optionally, said vacuum system is configured for directing said removed ink into said ink dump during air blasting.

Optionally, said printhead is a pagewidth inkjet printhead.

Optionally, said printhead is mounted on a support.

Optionally, said capper is sealingly engageable with said support.

Optionally, said support and said capper comprise complementary alignment features for locating said capper into said first position.

In a ninth aspect the present invention provides a capper for a printhead maintenance station, said capper comprising:

a capping chamber sealingly engageable around a printhead;

a constriction member positioned in said capper chamber, said constriction member dividing said capper chamber into an air inlet channel and a vacuum channel, said constriction member also defining a blast channel adjacent an ink ejection face of said printhead when said capping chamber is sealingly engaged around said printhead;

an air inlet defined in a wall of said capping chamber, said air inlet opening into said air inlet channel; and a vacuum aperture defined in a wall of said capping chamber, said vacuum aperture opening into said vacuum channel.

Optionally, said capping chamber comprises a perimeter gasket for sealing engagement around said printhead.

Optionally, said air inlet is in fluid communication with an air inlet valve.

Optionally, said vacuum aperture is in fluid communication with a vacuum system.

Optionally, said vacuum system is configured for generating a vacuum above said face, said vacuum purging ink from printhead nozzles onto said face.

Optionally, said constriction member is spaced apart from said face, thereby defining said blast channel, when said capping chamber is engaged around said printhead.

Optionally, said constriction member is spaced less than 0.5 mm from said face.

Optionally, said constriction member is substantially coextensive with said printhead.

Optionally, said vacuum system, said air inlet valve and said constriction member cooperate for blasting air through said blast channel, thereby removing ink from said face.

Optionally, said vacuum system and said air inlet valve are arranged to control a direction of air flow through said blast channel.

Optionally, said printhead comprises a wire bond encapsulant along one edge, and said air flow buffets into said encapsulant.

Optionally, capper further comprising an air inlet port and a vacuum port.

Optionally, said printhead is a pagewidth inkjet printhead.

Optionally, said printhead is mounted on a support.

Optionally, said capping chamber is sealingly engageable with said support.

Optionally, said capping chamber comprises at least one first alignment feature complementary with at least one second alignment feature on said support, said alignment features locating said capping chamber into sealing engagement around said printhead.

BRIEF DESCRIPTION OF THE DRAWINGS

Specific forms of the present invention will be now be described in detail, with reference to the following drawings, in which:—

DETAILED DESCRIPTION OF SPECIFIC EMBODIMENTS

Figure 1:
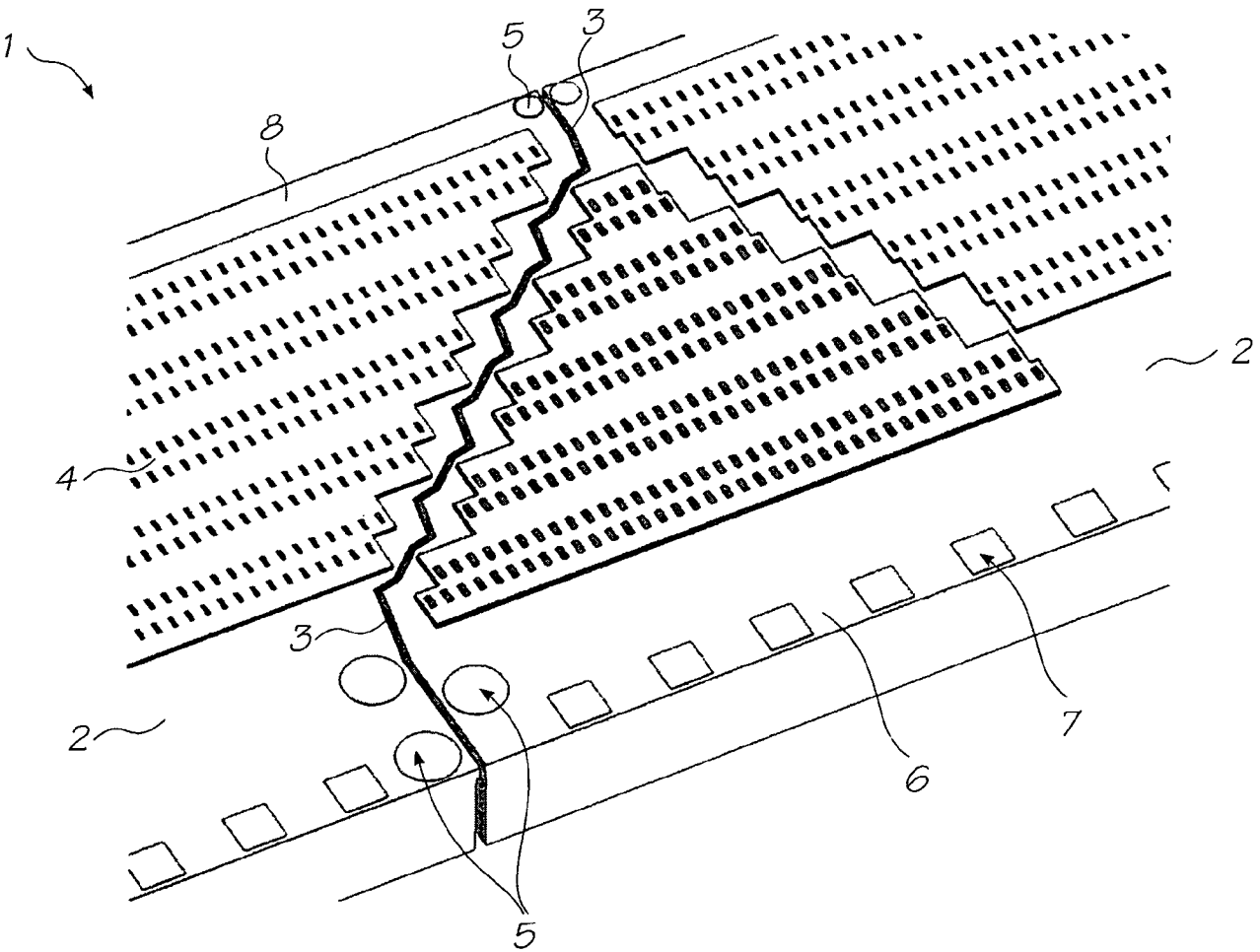
FIG. 1 is a perspective view of part of a printhead having wire bonding pads along one longitudinal edge portion.

Referring to FIG. 1, there is shown part of a printhead 1 comprised of aligned printhead integrated circuits 2 abutting along their transverse edges 3. A complete pagewidth printhead (not shown) is formed by an array of printhead integrated circuits 2 abutting across the width of a page. Each printhead integrated circuit 2 comprises rows of nozzles 4, which eject ink onto a print media (not shown) fed past the printhead. Fudicials 5 assist in aligning the array of printhead integrated circuits 2.

A longitudinal edge portion 6 of the printhead 1 comprises a plurality of bonding pads 7 to which will be attached wire bonds (not shown) in the fully assembled printhead. An opposite longitudinal edge portion 8 of the printhead 1 does not have any bonding pads.

Figure 2:
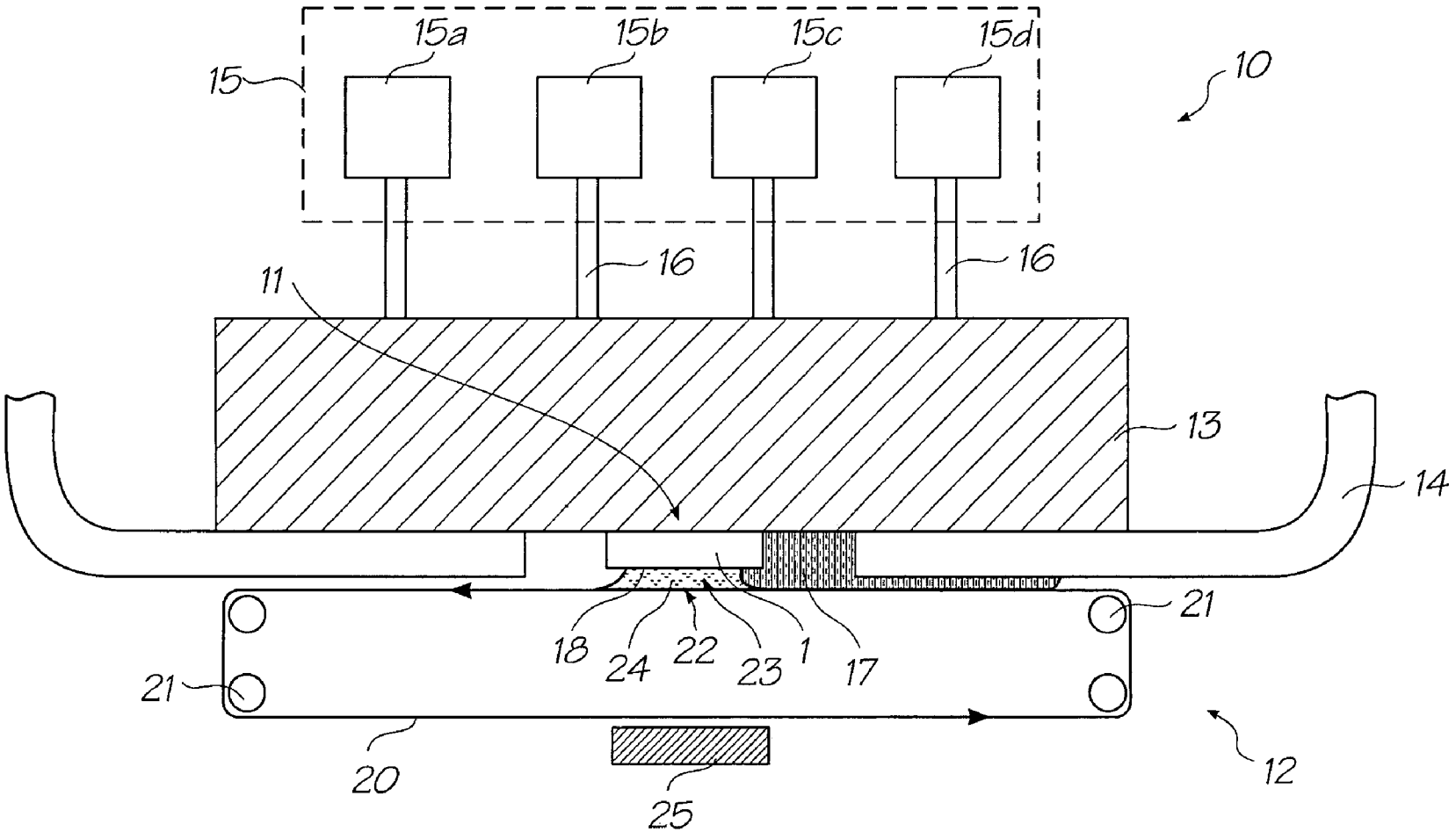
FIG. 2 is a schematic side view of a printhead maintenance assembly according to the invention in a cleaning configuration.

Referring now to FIG. 2, there is shown a schematic side view of a printhead maintenance assembly 10 comprising a printhead assembly 11 and an ink transport assembly 12. The printhead assembly 11 comprises the printhead 1 mounted to an ink supply manifold 13, which is itself mounted on a carrier frame 14. The ink supply manifold 13 supplies ink to ink supply channels etched into a backside of the printhead 1. The ink supply manifold 13 receives ink, via an ink supply system 16, from an ink reservoir 15. The ink reservoir 15 comprises a plurality of ink bags 15*a-d*, each ink bag containing a different colored ink (e.g. CMYK).

A polymeric encapsulant 17 extends from the longitudinal edge portion 6 of an ink ejection face 18 of the printhead 1. The encapsulant 17 encapsulates wire bonds (not shown) extending from the bonding pads. The wire bonds connect drive circuitry in the printhead 1 to a microprocessor (not shown), which controls operation of the printhead.

The ink transport assembly 12 comprises a film 20, which is wound in a loop around rollers 21. At least one of the rollers 21 is connected to a drive motor (not shown) for feeding the film 20 in the direction shown by the arrows. As shown in FIG. 2, the film 20 is in sealing contact with a surface of the encapsulant 17, which acts as film guide. The film 20 is fed in the direction shown through a transfer zone 22, which is a plane spaced apart from and parallel with the ink ejection face 18. A cavity 23 is defined at least partially by the film 20 in the transfer zone, the encapsulant 17 and the ink ejection face 18.

Ink 24 in the cavity 23 is transferred onto the film 20 in the transfer zone 22, and the film transports the ink away from the printhead 1. The ink transport assembly 12 also comprises an absorbent foam pad 25, which cleans the film 20 before it re-enters the transfer zone 22.

As shown in FIG. 2, the film 20 is engaged with the encapsulant 17 and a paper guide (not shown) is retracted in the carrier frame 14. However, the entire ink transport assembly 12 is moveable out of engagement with the encapsulant 17 when the printhead 1 is required to print.

Figure 3:
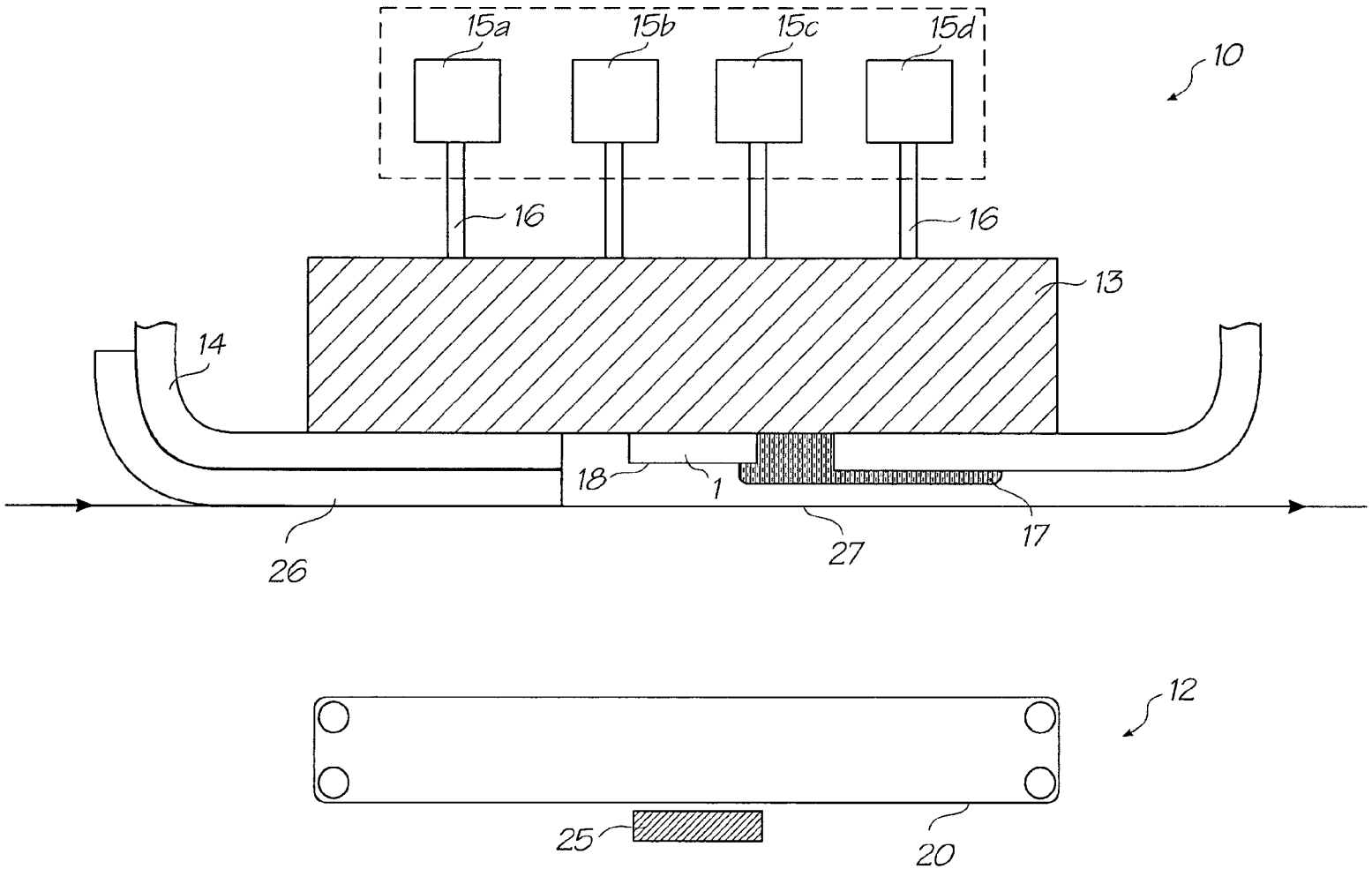
FIG. 3 is a schematic side view of a printhead maintenance assembly according to the invention in a printing configuration.

FIG. 3 shows the ink transport assembly 12 disengaged from the encapsulant 17 and a paper guide 26 in position for guiding paper 27 past the printhead 1. The paper 27 is fed in an opposite direction to the film 20.

Figure 4:
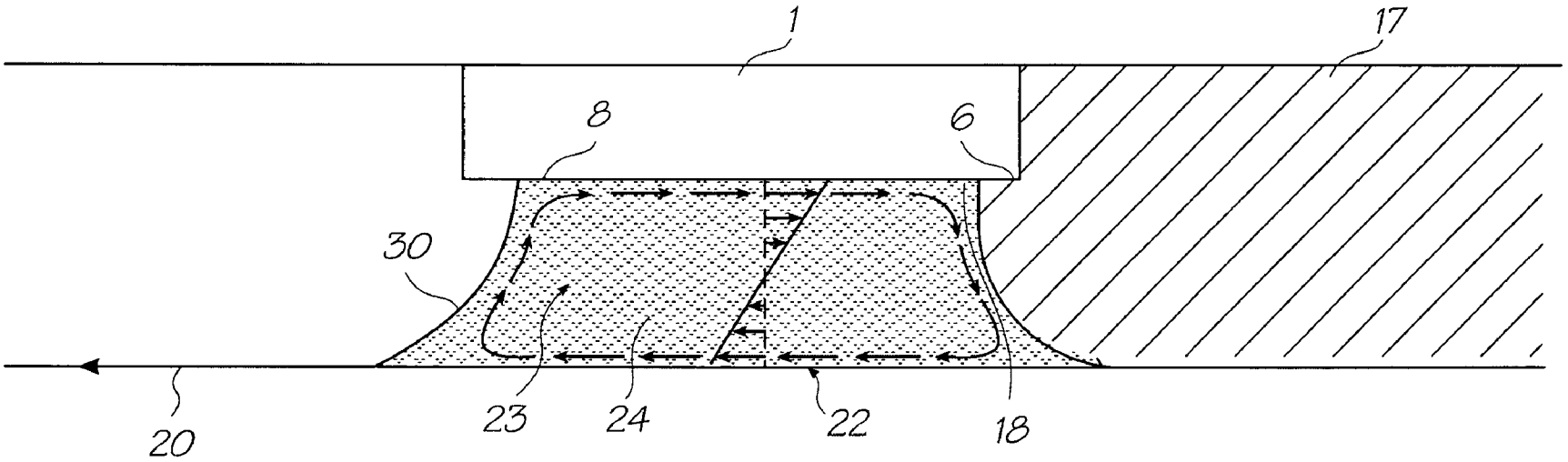
FIG. 4 shows in detail the motion of ink in the cavity adjacent the ink ejection face.

FIG. 4 shows in detail the cavity 23 and the movement of ink 24 which is flooded into the cavity as the film 20 is fed through the transfer zone 22. The cavity 23 is defined by the ink ejection face 18, the encapsulant 17 and the film 20 in the transfer zone 22. The encapsulant 17 is bonded to first longitudinal edge portion 6 and encapsulates wire bonds (not shown) extending from the printhead 1. At the opposite edge portion 8, the cavity 23 is open to the atmosphere and a meniscus 30 of ink 24 pins between this edge portion 8 and the film 20. As the film 20 is fed through the transfer zone 22, ink 24 is transferred onto the film by the motion of the film and the wetting surface characteristics of the film. A laminar flow of ink 24 is created in the cavity 23 (as shown by the arrows in FIG. 4), which continuously transfers ink onto the film 20 as it passes through the transfer zone 22. The ink 24 has particulates (not shown) from the ink ejection face 18 dispersed therein and these particulates are also transferred onto the film 20 and transported away from the printhead 1. Hence the ink ejection face 18 of the printhead 1 is cleared of particulates without being contacted.

Figure 5:
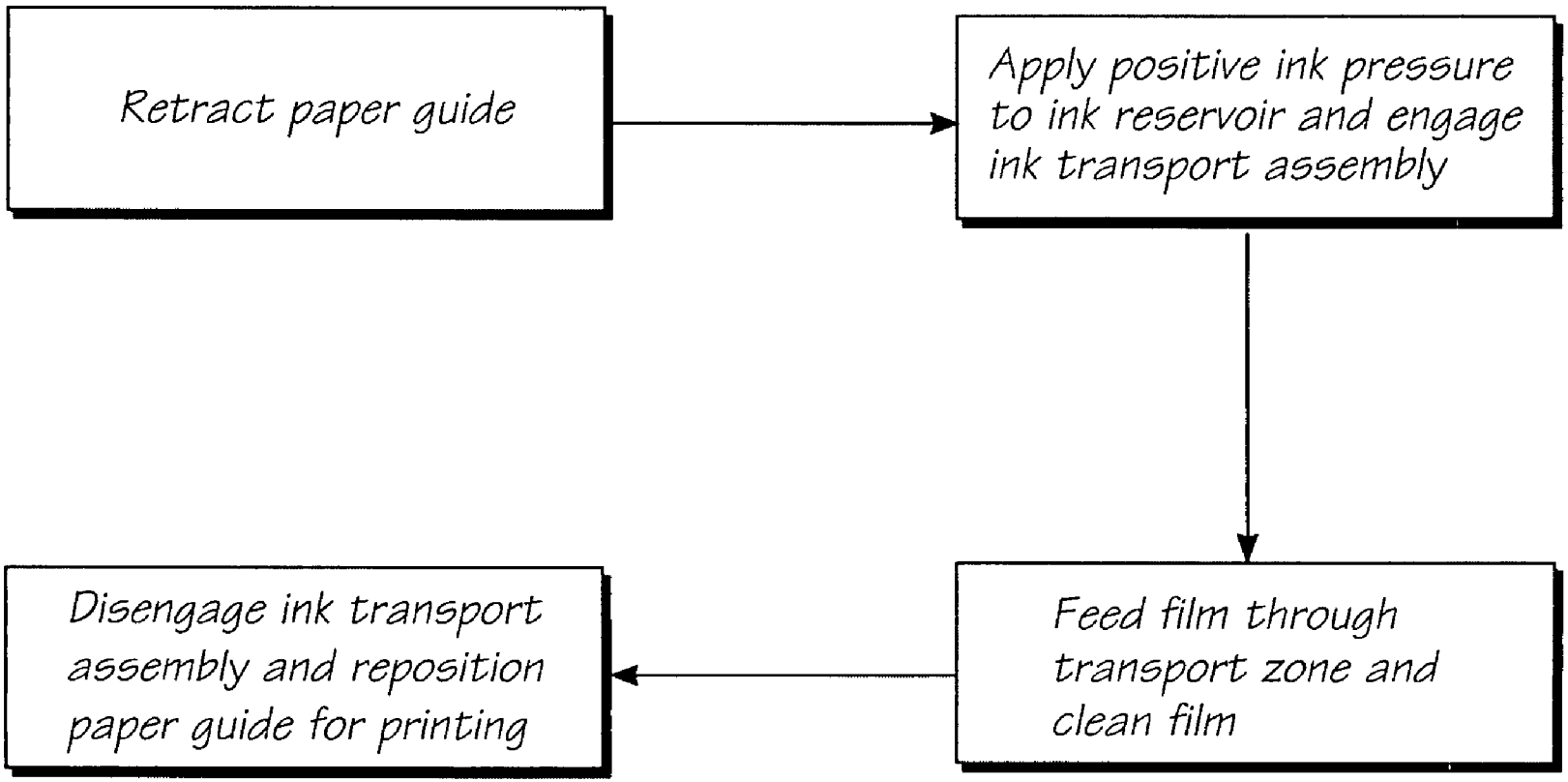
FIG. 5 is a process flow diagram for a printhead cleaning operation.

FIG. 5 is a process flow for a cleaning operation using the printhead maintenance assembly described above. In a first step, the paper guide 26 is retracted away from the path of the film 20. At the same time, or shortly thereafter, a positive pressure pulse is applied to the ink reservoir 13, which purges ink channels and floods the ink ejection face 18 with ink. During this step, particulates on the ink ejection face 18 are dispersed into the flooded ink by flotation. In a second step, the ink transport assembly 12 is moved into an engaged position in which the film 20 is positioned in the transfer zone 22 and sealingly contacts the encapsulant 17. In a third step, the film 20 is fed through the transfer zone 22, and ink 24 from the cavity 23 is transferred onto the film. Ink is cleaned from the film 20 by feeding the film past an absorbent pad 25 after it has passed through the transfer zone 22. Finally, in a fourth step, the ink transport assembly 12 is disengaged and the paper guide 26 repositioned for printing. The ink purging and film transport steps may be repeated in order to ensure complete remediation and cleaning of the printhead.

It will, of course, be appreciated that the present invention has been described purely by way of example and that modifications of detail may be made within the scope of the invention, which is defined by the accompanying claims.

The invention claimed is:

1. A method of removing foreign particulates from an ink ejection face of a pagewidth printhead mounted on a substrate, said substrate having a film guide positioned adjacent said printhead, said method comprising the steps of:

(a) flooding said face with ink from said printhead and dispersing said particulates into said flooded ink;

(b) positioning a polymer film in a transfer zone so as to define a cavity defined by said ink ejection face, said film guide and said polymer film, wherein said cavity is filled with said flooded ink; and (c) guiding said polymer film through said transfer zone, wherein movement of said polymer film in said transfer zone transfers said flooded ink onto said polymer film, and wherein said film guide encapsulates wire bonds extending from said printhead.

2. The method of claim 1, wherein said film guide is comprised of a solid polymeric material.

3. The method of claim 1, wherein said polymer film is guided past said face substantially parallel therewith and spaced apart therefrom.

4. The method of claim 1, wherein said film guide is positioned adjacent a longitudinal edge of said printhead.

5. The method of claim 1, wherein said film guide is substantially coextensive with a length of said printhead.

6. The method of claim 1, wherein said polymer film is guided transversely past said printhead.

7. The method of claim 6, wherein a width of said polymer film is substantially coextensive with a length of said printhead.

8. The method of claim 1, wherein said polymer film is fed past a film cleaner after being fed past said face.

9. The method of claim 8, wherein said film cleaner is an absorbent pad positioned remotely from said printhead.

10. The method of claim 8, further comprising controlling an amount and/or a period of applied positive pressure.

11. The method of claim 1, wherein said face is flooded with ink by positively pressurizing part of any ink supply system supplying ink to said printhead.

12. The method of claim 1, wherein said foreign particulates comprise paper dust.

* * * * *